US009101170B2

(12) United States Patent
Stone et al.

(10) Patent No.: US 9,101,170 B2
(45) Date of Patent: Aug. 11, 2015

(54) PROTECTIVE GLOVE LINER FOR USE IN ATHLETICS

(75) Inventors: Bradley Scott Stone, Georgetown, TX (US); Mark Maley, Kingwood, TX (US)

(73) Assignee: TetraMast LLC, Kingwood, TX (US)

( * ) Notice: Subject to any disclaimer, the term of this patent is extended or adjusted under 35 U.S.C. 154(b) by 443 days.

(21) Appl. No.: 13/539,895

(22) Filed: Jul. 2, 2012

(65) Prior Publication Data

US 2013/0007937 A1 Jan. 10, 2013

Related U.S. Application Data

(60) Provisional application No. 61/504,912, filed on Jul. 6, 2011.

(51) Int. Cl.
*A41D 10/00* (2006.01)
*A41D 19/00* (2006.01)

(52) U.S. Cl.
CPC ..... *A41D 19/00* (2013.01); *A41D 19/001* (2013.01); *A41D 19/0006* (2013.01)

(58) Field of Classification Search
CPC . A41D 19/00; A41D 19/001; A41D 19/0006; A41D 19/01505; A41D 19/002; A63B 71/141; A63B 71/143
USPC ..... 2/16, 20, 161.1, 167, 161.6
See application file for complete search history.

(56) References Cited

U.S. PATENT DOCUMENTS 3,255,461 A * 6/1966 Bullock ..... 2/159
3,787,898 A * 1/1974 Walker ..... 2/163
4,742,578 A * 5/1988 Seid ..... 2/2.5
4,748,690 A 6/1988 Webster
4,881,276 A * 11/1989 Swan ..... 2/161.1
5,339,465 A * 8/1994 Kyewski ..... 2/20
5,442,816 A * 8/1995 Seketa ..... 2/161.7
5,740,551 A * 4/1998 Walker ..... 2/16
5,768,704 A 6/1998 Greenhalgh
5,799,333 A * 9/1998 McGarry et al. ..... 2/161.6
5,819,313 A * 10/1998 McCrane ..... 2/16
5,829,057 A * 11/1998 Gunn ..... 2/69
5,898,938 A * 5/1999 Baylor et al. ..... 2/20
6,088,834 A 7/2000 Seminara
6,362,387 B1 * 3/2002 Carlson et al. ..... 602/41
6,721,960 B1 4/2004 Levesque et al.
6,944,884 B1 * 9/2005 Sokolowski ..... 2/161.1
8,671,463 B2 * 3/2014 Hawkes ..... 2/16
2008/0235850 A1 * 10/2008 Cabauy et al. ..... 2/161.8
2009/0288236 A1 * 11/2009 Hawkes ..... 2/20
2010/0240280 A1 * 9/2010 Michel ..... 450/39
2010/0325777 A1 12/2010 Radhakrishnan et al.
2011/0067165 A1 3/2011 Fream et al.
2011/0162122 A1 * 7/2011 Wright et al. ..... 2/69
2013/0227760 A1 * 9/2013 Mahon ..... 2/160

* cited by examiner

*Primary Examiner* — Amy Vanatta

(74) *Attorney, Agent, or Firm* — Burns & Levinson, LLP; Joseph M. Maraia

(57) ABSTRACT

A protective inner athletic glove for use with an outer athletic glove. The inner athletic glove includes a glove body including a moisture wicking, elastic fabric material for covering at least a portion of a user's hand and one or more protective barrier layers attached to an outer surface of the glove body, the one or more protective barrier layers comprising a material to reduce a coefficient of friction between the glove body and an inner surface of an outer athletic glove.

19 Claims, 6 Drawing Sheets

PROTECTIVE GLOVE LINER FOR USE IN ATHLETICS

RELATED APPLICATIONS

The present application claims priority to U.S. Provisional Patent Application No. 61/504,912, filed Jul. 6, 2011, which is incorporated in its entirety herein by reference.

BACKGROUND

Sporting activities requiring use of implements such as bats, clubs, sticks, bars, oars or racquets often subject participants to very painful injuries to the hand, which manifest in the form of blisters, contusions, and lesions. Many gloves designed to prevent injuries of this type are not effective in providing adequate protection to the wearer when exposed to the vigorous practice regimens required by many of today's athletes.

SUMMARY

The technology described herein relates to protective glove liners. The embodiments described herein provide a dramatic improvement to the ability of a glove to prevent skin surface injuries by providing a secondary barrier layer underneath the traditional leather gloves worn during sporting activities. This glove is considered a glove liner in as much as it is designed to be worn with and work in concert with an outer glove. It is designed to provide a barrier between the inner surface of a leather glove and the surface of the skin, reducing the effects of friction on the skin created between the hand and the implement. The glove liner is made from moisture wicking fabric which reduces the amount of moisture on the skin by adding a wicking barrier that will channel the perspiration outward into the outer glove away from the skin.

One benefit the embodiments described is to provide a layering glove designed to be worn underneath an outer glove to provide added protection to specific parts of the hand when using an implement to strike or lift an object during sports activities.

Another benefit of the embodiments described is to provide a moisture-wicking layer between the skin and outer glove to reduce amount of perspiration between the skin and outer glove.

Another benefit of the embodiments described is to reduce the amount of frictional force applied directly to the skin when striking or lifting an object with an implement such as a bat, club, stick, racquet, pole, or bar during sports activity.

Another benefit of the embodiments described is to dissipate the amount of pressure applied directly to the skin when striking or lifting an object with an implement such as a bat, club, stick, racquet, pole, or bar during sports activity.

Another benefit of the embodiments described is to provide a tight-fitting, pliable, stretch-knit, inner layering glove made from polyester, nylon, Lycra®, or other similar synthetic fibers for added comfort.

Another benefit of the embodiments described is to provide a slight amount of compression to the hand and wrist for added support during sports activity.

Another benefit of the embodiments described is that it can be worn with, and function in concert with an outer glove without interfering with the outer glove's performance.

Another benefit of the embodiments described is to allow a player/participant to practice longer without risk of early fatigue or soreness.

Another benefit of the embodiments described is to also afford added protection to the skin using more or less padding as preferred by the wearer, based on his/her specific needs.

One embodiment is a protective inner athletic glove for use with an outer athletic glove. The inner athletic glove includes a glove body including a moisture wicking, elastic fabric material for covering at least a portion of a user's hand. The inner athletic glove includes one or more protective barrier layers attached to an outer surface of the glove body, the one or more protective barrier layers comprising a material to reduce a coefficient of friction between the glove body and an inner surface of an outer athletic glove.

In some embodiments, the moisture wicking, elastic fabric material has an inner surface in contact with the user's hand, wherein the inner surface has a frictional coefficient rating that reduces friction between the inner athletic glove and the user's hand. In some embodiments, the glove body includes one or more appendages for covering at least a portion of one or more fingers of the user's hand. In some embodiments, the one or more protective barrier layers are attached to the outer surface of the glove body to form a pocket.

In some embodiments, the inner athletic glove includes a padding layer located in the pocket of the glove body. In some embodiments, the pocket includes an opening allowing for a padding layer to be placed into or removed from the pocket. In some embodiments, the moisture wicking, elastic synthetic fabric material wicks moisture away from the user's hand.

One embodiment is a protective inner glove for use with an outer glove. The inner glove includes a glove body including a moisture wicking, elastic fabric material for covering at least a portion of a user's hand. The inner glove includes one or more protective barrier layers attached to an outer surface of the glove body, the one or more protective barrier layers comprising a material to reduce a coefficient of friction between the glove body and an inner surface of an outer glove.

Other aspects and advantages of the current invention will become apparent from the following detailed description, taken in conjunction with the accompanying drawings, illustrating the principles of the invention by way of example only.

BRIEF DESCRIPTION OF THE DRAWINGS

The foregoing features of various embodiments of the invention will be more readily understood by reference to the following detailed descriptions in the accompanying drawings.

FIG. 2(*b*) is a schematic view of the interior (inner surface) of the palm in a glove liner designed for use when swinging a baseball or softball bat, according to an illustrative embodiment.

FIG. 2(*c*) is a schematic cross-sectional view of a 3 mm barrier pad which can be inserted into the patch pocket of a glove liner designed for use when swinging a baseball or softball bat, according to an illustrative embodiment.

DETAILED DESCRIPTION OF ILLUSTRATIVE EMBODIMENTS

Figure 1:
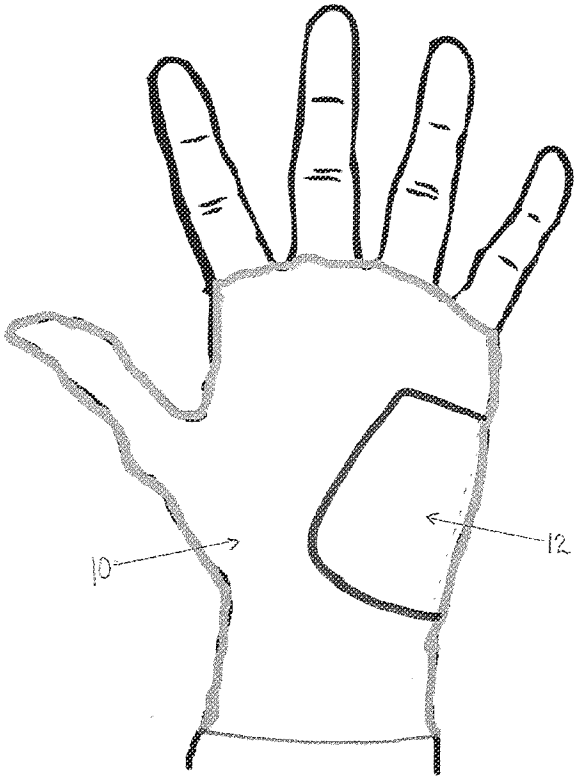
FIG. 1 is a schematic palm view of a glove liner with barrier patch configured for use when swinging a baseball or softball bat, according to an illustrative embodiment.

Embodiments described include a glove liner designed to be worn on the hand, having a back, two sides, palm, and may or may not include appendages. The glove liner extends past the wearer's wrist to the lower forearm. The glove liner is made using a material that is a thin, pliable, fabric. Exemplary materials used to fabricate the liner include polyester, nylon, Lycra, or any similar material that provides a fit snug to the skin, and is highly elastic. A secondary protective barrier layer is added to specific locations of the palm or appendages of the glove liner that are exposed to a high level of pressure and friction when using implements such as bats, clubs, sticks, poles, or bars during sports activities. This barrier layer includes a woven nylon or similar material, having a relatively low frictional coefficient rating (e.g., 0.20 or less). Reducing the amount of friction between the inner surface of a glove and the skin provides an increased level of comfort, and reduces damage sustained by the hand during rigorous athletic activity (e.g., reduces blisters and abrasions). This barrier layer patch is attached (e.g., permanently) to the body of the glove liner on three sides, with a fourth side not permanently sealed, forming a pocket, to accommodate additional protective material such as a neoprene, ethylene vinyl acetate, polystyrene, polyethylene pad, or other closed cell material, which may be inserted underneath the barrier layer. The additional padding acts to reduce the amount of direct pressure applied to the surface of the hand, providing an additional layer of protection and comfort. In some embodiments, the thickness of this additional padding can range from 2 mm to 12.7 mm, allowing the wearer to choose the desired level of protection and comfort specific to their needs. The interchangeable pad can be inserted beneath the barrier layer patch via the open edge, and can be removed the same way if desired.

Materials used in conventional gloves are designed to enhance grip more so than to protect the surface of the hand. The primary material used in conventional gloves is leather; constructed in a thin, tight fitting manner, with the inner surface of the leather being unfinished, and not as smooth as the exterior surface. This is important to point out since it is the inner surface of the glove that actually contacts the skin.

Some gloves include padding, permanently affixed and strategically located to prevent damage to the hand from external contact. Having this padding sewn into the exterior surface of the glove in the palm, wrist, and finger regions is ineffective in reducing the amount of frictional force applied to the skin by the inner surface of the glove material, as the glove simply moves across the skin under the force of the implement. Nowhere is this more evident than in the sport of hockey, where gloves exhibiting massive amounts of padding still fail to provide adequate protection against blisters and surface damage to ones hands.

Keeping the hands free from excess moisture is another key component to preventing the development of skin surface injuries. Leather absorbs and retains moisture, keeping the surface of the skin exposed to a high level of perspiration thus contributing to the development of skin surface injuries.

Figure 2A:
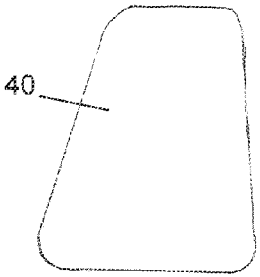
FIG. 2(*a*) is a schematic view of a barrier patch for a glove liner designed for use when swinging a baseball or softball bat, according to an illustrative embodiment.
Figure 2B:
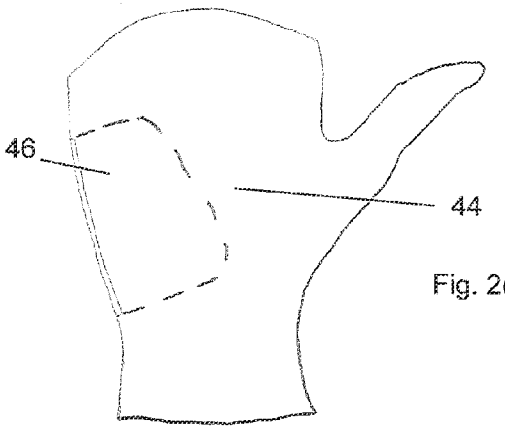
Figure 2C:
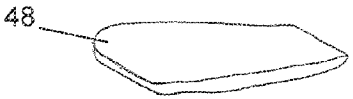
Figure 3:
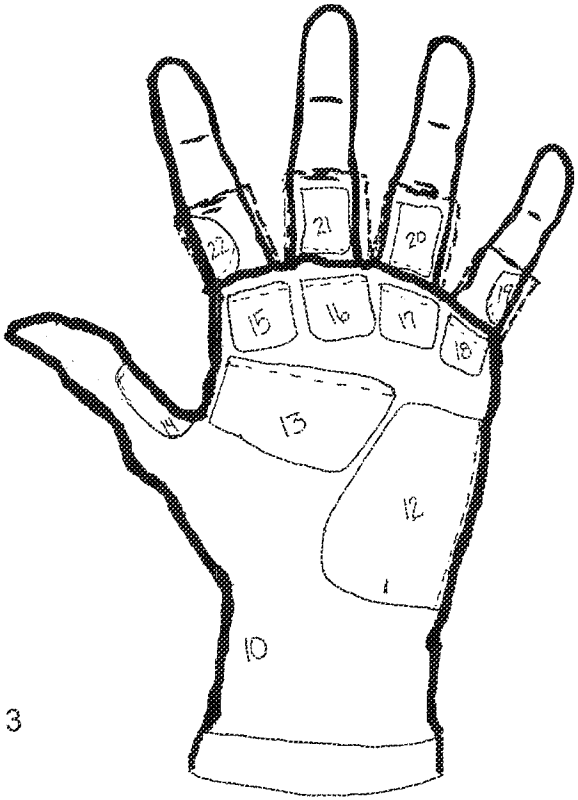
FIG. 3 is a schematic palm view of the left hand illustrating possible barrier patch locations on glove liners designed for hockey, golf, lacrosse, cricket, weight training, or rowing, according to an illustrative embodiment.
Figure 4:
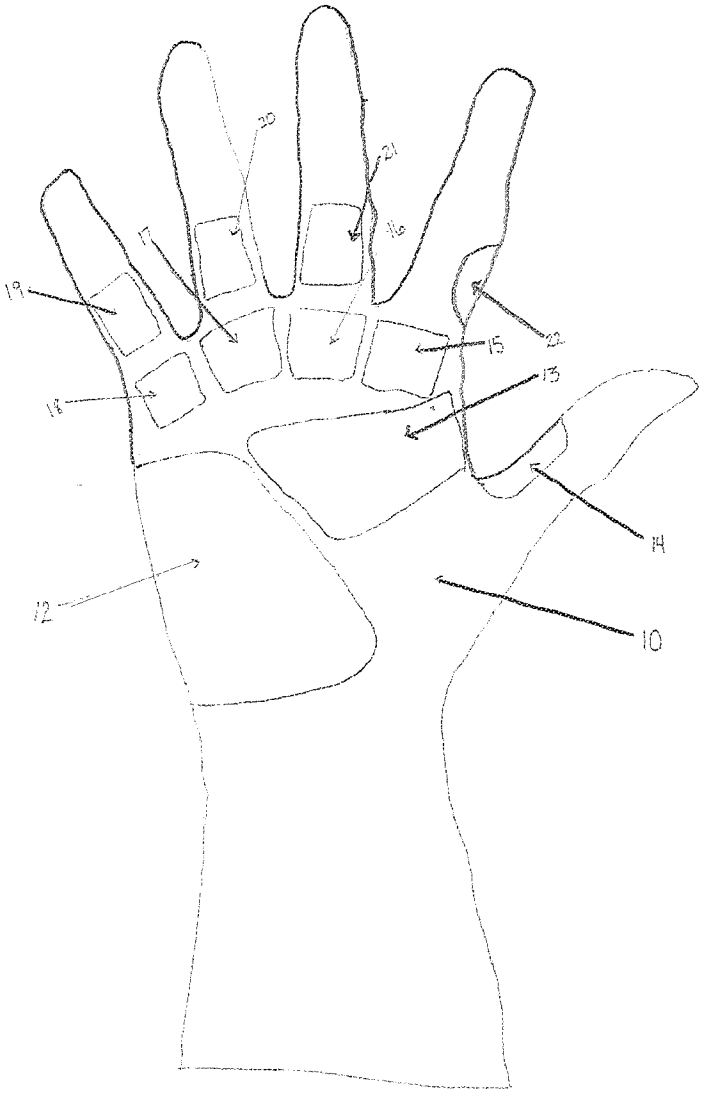
FIG. 4 is a schematic palm view of the right hand illustrating possible barrier patch locations on glove liners designed for hockey, golf, lacrosse, cricket, weight training, or rowing, according to an illustrative embodiment.
Figure 5:
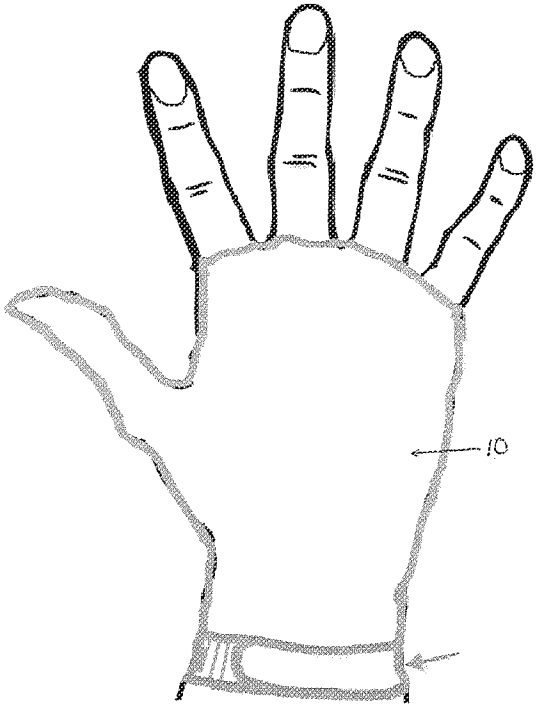
FIG. 5 is a schematic back of hand view showing location of adjustable closure and cuff, according to an illustrative embodiment.

FIGS. 1, 2(*a*)-2(*c*), 3, 4, 5, and 6 illustrate how the various components of a protective glove liner 10 can be configured and worn to provide enhanced protection to specific regions of the hand that experience a high level of friction and pressure during sports activities utilizing implements such as bats, clubs, sticks, poles, bars, oars, or racquets.

This glove liner 10 comprises a moisture wicking, stretch synthetic fabric, and is configured to be worn underneath leather gloves specific to sports activities. The glove liner 10 includes 600-4000 denier woven nylon barrier pockets 12, 13, 14, 15, 16, 17, 18, 19, 20, 21, 22 strategically placed for added protection from friction and pressure which occurs when using implements in sports activities.

The sport-specific regions of the hand needing additional protection include, but are not limited to:

- baseball/softball—fingerless glove liner featuring harrier patch location 12;
- golf—half finger on index, fingerless elsewhere featuring barrier patch location 12 and 22;
- hockey—half finger throughout with barrier patch locations 12, 13, 14, 15, and 22;
- lacrosse—half finger throughout with barrier patch locations 12, 13, 14, 15, 16, 17, 18, 19, 20, 21, and 22;
- tennis—fingerless glove liner with barrier patch locations 12, 14, and 22;
- rowing—half finger throughout with barrier patch locations 12, 14, 15, 16, 17, 18, 19, 20, and 21;
- weight training—fingerless throughout with barrier patch locations 13, 14, 15, 16, 17, and 18;
- cricket—fingerless throughout with barrier patch locations 12, 13, 14, and 22.

In one embodiment, the glove liner is made of a polyester/Lycra (spandex) blended fabric. Lycra is a lightweight, breathable fabric that uses compression to fit closely to the body. In comparison, most athletic gloves are made of various forms of leather, which also offer a snug fit initially, but which stretches over time and is prone to tearing. The Lycra blended fabric allows the glove liner 10 to be continually stretched (e.g., up to 100 times its original sizer and return to its original form. It is also highly resistant to tearing due to the highly elastic property of the fabric.

Leather gloves, such as that cited in Webster's U.S. Pat. No. 4,748,690 absorb moisture and have a very high moisture retention rate, keeping a moisture layer present between the inner surface of the glove and surface of the skin. Embodiments of the glove liner described herein are designed to enhance "moisture wicking" (transport of moisture away from the skin) from the skin to the outer glove providing a barrier between the inner surface of the outer glove and ones skin, reducing the amount of moisture present on the skin. The presence of moisture would otherwise facilitate the creation of blisters and other skin surface injuries.

Webster's glove is designed with non-springy cushions for the purpose of dampening impact on ones hand when catching a thrown or batted ball. It does not address the issue associated with injuries caused by repetitive frictional pressure when swinging, lifting, rowing, throwing, or otherwise using an implement such as a bat, club, racquet, bar, pole, or oar in sports activities. Webster's glove does not, nor is it intended to, reduce/prevent the occurrence of blisters or abrasions caused by friction and pressure, but instead acts to reduce/prevent bruising and other deep tissue injuries resulting from catching a thrown or batted ball, and is intended to be worn underneath a baseball/softball glove designed for catching, not a batting glove designed for hitting a ball.

The glove liner 10 described herein is made primarily of moisture-wicking fabric, for example, comprising a blend of polyester and spandex/Lycra, with ballistic nylon patches located in areas of the hand where one would experience a high occurrence of friction and pressure while using an implement such as abut, club, racquet, bar, pole, or oar during sports activities. The glove liner 10 is constructed using a recessed or flat stitch process on all contact points in the palm and interior surface of the fingers to eliminate the possibility of the stitching protruding from the exterior surface of the glove causing irritation, and enhance the level of comfort. Interior stitching such as that along the outer edges of both the hand and fingers is of a typical single run-stitch manufacturing process, and the finger/thumb openings feature a doubling over and stitching of the fabric to increase strength/durability in these high stress areas. An adjustable arm band, with a Velcro-type closure is sewn into the cuff of the glove liner allowing the wearer to customize the glove liners fit to their appropriate comfort level. Areas designated for added protection would include: Hypothenar—outer third of the palm opposite the thumb (12), the crease of the palm to the thumb and index finger covering the distal and proximal palmar (13), lower half of the thumb's interior surface (14), metacarpophalangeal joints of each finger in the palm region (15, 16, 17, 18), interior lower third of each finger between the metacarpophalangeal joint in palm and the proximal interphalangeal crease (19, 20, 21, 22). The designated areas needing additional protection are covered by a patch of woven ballistic nylon (e.g., no less than 600 denier in thickness with palm patches (12 and 13) having a pocket located on the interior of the glove liner to accommodate additional padding (see, FIGS. 2(*b*) and 2(*c*)), if desired. This additional padding provides added protection to areas exposed to exceptional levels of friction and pressure when using an implement such as a bat, club, racquet, bar, pole, or oar during sports activities. Webster's design is focused solely on protecting the hand from injuries sustained when catching a thrown or batted ball, and does nothing more than any other glove to reduce friction on the skin.

FIG. 2(*a*) is a schematic view of a barrier patch 40 for a glove liner designed for use when swinging a baseball or softball bat, according to an illustrative embodiment. FIG. 2(*b*) is a schematic view of the interior 44 (inner surface) of the palm in the glove liner of FIG. 2(*a*). FIG. 2(*c*) is a schematic cross-sectional view of a 3 mm barrier pad 48 which can be inserted into the patch pocket 46 of the glove liner of FIG. 2(*b*).

In this embodiment, protective barrier patch (12) is designed to cover the hypothenar region of the palm, with the top of the patch approximately 3 cm below the palmar digital crease of the small finger, extending from the outer edge of the palm inward toward the center of the palm 5 cm, with a height of 6 cm, and width at the bottom of the patch of 6 cm. Exemplary dimensions of the protective barrier patch located in the palm covering the distal and proximal palmar region (13) is 8 cm wide and 3 cm high (see Table 1).

TABLE 1

| Exemplary patch sizes | | |
|---|---|---|
| Patch No. | Width (cm) | Height (cm) |
| 12 | 5 | 6 |
| 13 | 8 | 3 |

TABLE 1-continued

| Exemplary patch sizes | | |
|---|---|---|
| Patch No. | Width (cm) | Height (cm) |
| 14 | 2.5 | 3 |
| 15 | 2 | 2 |
| 16 | 2 | 2 |
| 17 | 2 | 2 |
| 18 | 2 | 2 |
| 19 | 2 | 2 |
| 20 | 1.8 | 2 |
| 21 | 1.8 | 2 |
| 22 | 2 | 2 |

The glove liner is configured to be worn with and work in concert with outer athletic gloves to reduce friction/pressure to key parts of the hand when using implements such as bats, clubs, sticks, poles, racquets, bars, or oars, during sports activities.

Patch 12 reduces friction/pressure to the hypothenar region of the palm, beginning just above the wrist crease and extending upward to the distal palmar, and from the outer edge of the palm inward to the thenar region of the palm.

Patch 13 reduces friction/pressure to the upper palm area with the lower edge running along the proximal palmar, and the upper edge covering the distal palmar, extending from interior edge of the palm between the thumb and index finger inward to just past the exterior edge of the ring finger.

Patch 14 reduces friction/pressure to the interior region of the proximal phalanx of the thumb, beginning just above the basilar joint, extending upward to just below the metacarpophalangeal joint and positioned to cover the interior surface of this region.

Patch 15 reduces friction/pressure to the metacarpophalangeal (MCP) region of the index finger, beginning at the proximal palmar, extending upward to just below the proximal phalanx (palmar digital) crease, with the width of the patch extending 1 cm in both directions from a vertical centerline through the MCP joint of the index finger.

Patch 16 reduces friction/pressure to the MCP region of the middle finger, with the top of the patch located just below the palmar digital crease of the middle finger extending downward 2 cm, and outward 1 cm in both directions from a vertical centerline through the MCP joint of the middle finger.

Patch 17 reduces friction/pressure to the MCP region of the ring finger, with the top of the patch located just below the palmar digital crease of the ring finger extending downward 2 cm, and outward in both directions 1 cm from a centerline through the MCP joint of the ring finger.

Patch 18 reduces friction/pressure to the MCP region of the small finger, with the top of the patch just below the palmar digital crease of the small finger extending downward 2 cm, and outward in both directions 1 cm from a centerline through the MCP joint of the small finger.

Patch 19 reduces friction/pressure to the proximal phalangeal region of the small finger, with the top of the patch located just below the proximal interphalangeal crease of the small finger, extending downward to just above the palmar digital crease and outward 1 cm in both directions from a vertical centerline of the proximal phalanx of the small finger.

Patch 20 reduces friction/pressure to the proximal phalanx region of the ring finger, with the top of the patch located just below the proximal interphalangeal crease, extending downward to just above the palmar digital crease, and outward 1 cm in both directions from a vertical centerline of the proximal phalanx of the ring finger.

Patch 21 reduces friction/pressure to the proximal phalanx region of the middle finger, with the top of the patch located just below the proximal interphalangeal crease, extending downward to just above the palmar digital crease, and outward 1 cm in both directions from a vertical centerline of the proximal phalanx of the ring finger.

Patch 22 reduces friction/pressure to the proximal phalanx region of the index finger, with the top of the patch located just below the proximal interphalangeal crease, extending downward to just above the palmar digital crease, and outward 1 cm in both directions from a vertical centerline of the proximal phalanx of the index finger.

The glove liner 10 has a sleeve extending from the hand past the wrist to the lower forearm region which the same moisture wicking polyester/spandex (Lycra) fabric. This compression fabric provides added comfort not only to the hand but also added support to the wrist and lower forearm region. The sleeve portion of this glove liner includes an adjustable strap closure featuring a hook and loop fabric allowing ease when putting the glove liner on or removing it.

Injuries resulting from excessive friction and pressure to on ones hand, when using an implement such as bat, club, stick, bar, pole, racquet, or oar during sporting activities, typically come in the form of a blistering of the skin. The size and severity of the injury will vary from case to case, but the most common injury is typically the size of a quarter, and can be very painful, much of the time requiring medical attention. In severe instances subsurface tissue damage occurs leaving the individual with permanent scarring and discomfort. While there are many leather gloves on the market designed to limit damage, none provide the moisture wicking and friction resistance effects this glove liner affords the wearer.

Figure 6:
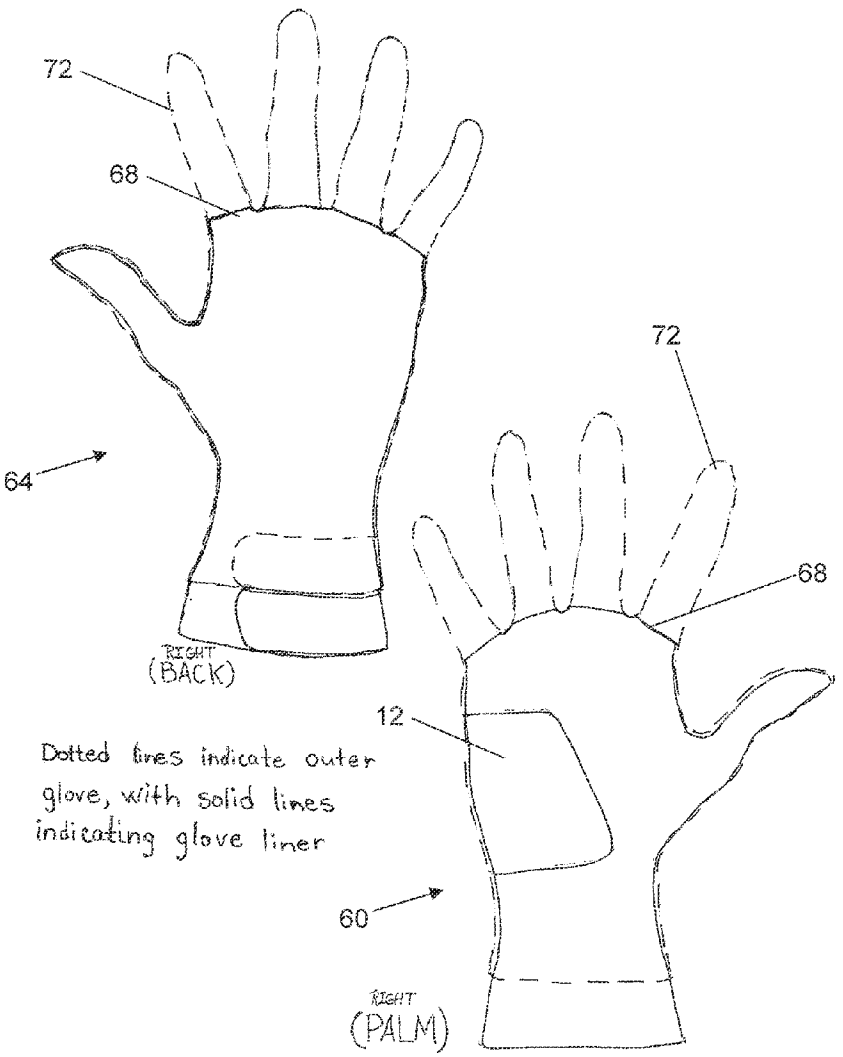
FIG. 6 is a schematic palm view and back of hand view of a glove liner designed for use when swinging a baseball or softball bat, shown in use with a typical leather batting glove designed for baseball or softball, according to an illustrative embodiment.

FIG. 6 is a schematic palm view 60 and back of hand view 64 of a glove liner 68 designed for use when swinging a baseball or softball bat, shown in use with a typical leather batting glove 72 designed for baseball or softball, according to an illustrative embodiment. The inner glover liner 68 includes patch 12 to reduce friction/pressure to the hypothenar region of the palm, beginning just above the wrist crease and extending upward to the distal palmar, and from the outer edge of the palm inward to the thenar region of the palm. In an effort to test viability and effectiveness, one embodiment of the glove liner was tested on two subjects. In both cases, after more than 100 swings of a baseball/softball bat, using this liner underneath the subject's leather batting glove, there was no ill effect to the palm. Both of these participants had a history of getting palm blisters when going through this type of hitting regiment, using only a leather batting gloves, in the past.

Comprise, include, and/or plural forms of each are open ended and include the listed parts and can include additional parts that are not listed. And/or is open ended and includes one or more of the listed parts and combinations of the listed parts.

One skilled in the art will realize the invention may be embodied in other specific forms without departing from the spirit or essential characteristics thereof. Various alternative implementations are within the scope of the invention. The technology described can be implemented on or with gloves that are not only for athletic use. In some implementations, both the inner and outer gloves are not athletic gloves. The foregoing embodiments are therefore to be considered in all respects illustrative rather than limiting of the invention described herein. Scope of the invention is thus indicated by the appended claims, rather than by the foregoing description, and all changes that come within the meaning and range of equivalency of the claims are therefore intended to be embraced therein.

What is claimed is:

1. A protective inner athletic glove for use with an outer athletic glove, the inner athletic glove comprising:

a glove body including a moisture wicking, elastic fabric material for covering at least a portion of a user's hand;

a protective barrier layer attached to an outer surface of the glove body at a location specific to a sport being played by the user corresponding to only a hvpothenar region of the user's palm, the protective barrier layer being in contact with an inner surface of an outer athletic glove and comprising a woven nylon material having a low coefficient of friction to reduce friction between the user's hand and the inner surface of the outer athletic glove.

2. The inner athletic glove of claim 1, wherein the moisture wicking, elastic fabric material has an inner surface in contact with the user's hand, wherein the inner surface has a low coefficient of friction that reduces friction between the inner athletic glove and the user's hand.

3. The inner athletic glove of claim 1, wherein the glove body includes one or more appendages for covering at least a portion of one or more fingers of the user's hand.

4. The inner athletic glove of claim 1, wherein the protective barrier layer is attached to the outer surface of the glove body to form a pocket.

5. The inner athletic glove of claim 4, comprising a padding layer located in the pocket of the glove body.

6. The inner athletic glove of claim 4, wherein the pocket includes an opening allowing for a padding layer to be placed into or removed from the pocket.

7. The inner athletic glove of claim 1, wherein the moisture wicking, elastic fabric material wicks moisture away from the user's hand.

8. A protective inner athletic glove for use with an outer athletic glove, the inner athletic glove comprising:

a glove body including a moisture wicking, elastic fabric material for covering at least a portion of a user's hand;

a plurality of protective barrier layers attached to an outer surface of the glove body at locations specific to a sport being played by the user including at least locations corresponding to a hypothenar region of the user's palm and an interior region of a proximal phalanx of the user's thumb, the plurality of protective barrier layers being in contact with an inner surface of an outer athletic glove and comprising a woven nylon material having a low coefficient of friction to reduce friction between the user's hand and the inner surface of the outer athletic glove.

9. The inner athletic glove of claim 8, wherein the glove body includes one or more appendages for covering at least a portion of one or more fingers of the user's hand.

10. The inner athletic glove of claim 8, wherein the plurality of protective barrier layers are attached to the outer surface of the glove body to form pockets.

11. The inner athletic glove of claim 10, comprising a padding layer located in each of the pockets of the glove body.

12. A protective inner athletic glove for use with an outer athletic glove, the inner athletic glove comprising:

a glove body including a moisture wicking, elastic fabric material for covering at least a portion of a user's hand;

a plurality of protective barrier layers attached to an outer surface of the glove body at locations specific to a sport being played by the user including at least locations corresponding to an upper palm area of the user's palm and an interior region of a proximal phalanx of the user's thumb, the plurality of protective barrier layers being in contact with an inner surface of an outer athletic glove and comprising a woven nylon material having a low coefficient of friction to reduce friction between the user's hand and the inner surface of the outer athletic glove.

13. The inner athletic glove of claim 12, wherein the glove body includes one or more appendages for covering at least a portion of one or more fingers of the user's hand.

14. The inner athletic glove of claim 12, wherein the plurality of protective barrier layers are attached to the outer surface of the glove body to form pockets.

15. The inner athletic glove of claim 14, comprising a padding layer located in each of the pockets of the glove body.

16. A protective inner athletic glove for use with an outer athletic glove, the inner athletic glove comprising:

a glove body including a moisture wicking, elastic fabric material for covering at least a portion of a user's hand;

a plurality of protective barrier layers attached to an outer surface of the glove body at locations specific to a sport being played by the user including at least locations corresponding to a hypothenar region of the user's palm and a proximal phalanx region of the user's index finger, the plurality of protective barrier layers being in contact with an inner surface of an outer athletic glove and comprising a woven nylon material having a low coefficient of friction to reduce friction between the user's hand and the inner surface of the outer athletic glove.

17. The inner athletic glove of claim 16, wherein the glove body includes one or more appendages for covering at least a portion of one or more fingers of the user's hand.

18. The inner athletic glove of claim 16, wherein the plurality of protective barrier layers are attached to the outer surface of the glove body to form pockets.

19. The inner athletic glove of claim 18, comprising a padding layer located in each of the pockets of the glove body.

* * * * *